US009115416B2

(12) United States Patent
Hamada et al.

(10) Patent No.: US 9,115,416 B2
(45) Date of Patent: Aug. 25, 2015

(54) HIGH-YIELD-RATIO AND HIGH-STRENGTH STEEL SHEET EXCELLENT IN WORKABILITY

(71) Applicant: Kabushiki Kaisha Kobe Seiko Sho (Kobe Steel, Ltd.), Kobe-shi (JP)

(72) Inventors: Kazuyuki Hamada, Kakogawa (JP); Tatsuya Asai, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 344 days.

(21) Appl. No.: 13/690,552

(22) Filed: Nov. 30, 2012

(65) Prior Publication Data

US 2013/0153096 A1 Jun. 20, 2013

(30) Foreign Application Priority Data

Dec. 19, 2011 (JP) ..... 2011-277528

(51) Int. Cl.

| | |
|---|---|
| ***C22C 38/02*** | (2006.01) |
| ***C22C 38/04*** | (2006.01) |
| ***C22C 38/12*** | (2006.01) |
| ***C22C 38/14*** | (2006.01) |
| ***C21D 8/02*** | (2006.01) |

(Continued)

(52) U.S. Cl.

CPC ..... *C21D 8/0263* (2013.01); *C21D 6/005* (2013.01); *C21D 8/0226* (2013.01); *C21D 8/0236* (2013.01); *C21D 8/0247* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01); *C22C 38/26* (2013.01); *C22C 38/28* (2013.01); *C22C 38/32* (2013.01); *C22C 38/38* (2013.01); *C21D 2211/002* (2013.01); *C21D 2211/005* (2013.01); *C21D 2211/008* (2013.01)

(58) Field of Classification Search

None

See application file for complete search history.

(56) References Cited

U.S. PATENT DOCUMENTS

| | | | |
|---|---|---|---|
| 2003/0063996 | A1 | 4/2003 | Funakawa et al. |
| 2004/0074573 | A1 | 4/2004 | Funakawa et al. |
| 2010/0108200 | A1 | 5/2010 | Futamura et al. |

FOREIGN PATENT DOCUMENTS

| | | | |
|---|---|---|---|
| CN | 101724776 | A | 6/2010 |
| JP | 55-122820 | A | 9/1980 |

(Continued)

OTHER PUBLICATIONS

Machine-English translation of Japanese patent No. 2000-282175, Kawabe Hidenao et al., Oct. 10, 2000.*

(Continued)

*Primary Examiner* — Deborah Yee

(74) *Attorney, Agent, or Firm* — Oblon, McClelland, Maier & Neustadt, L.L.P.

(57) ABSTRACT

Provided is a steel sheet having a tensile strength of 980 MPa or more and exhibiting a high yield ratio and an excellent workability. The steel sheet includes C, Si, Mn, B, at least one of Ti, Nb and V, P, S, Al and N, the content by percentage of each of which is in a specified range. The metal structure thereof includes bainite, and martensite and may include ferrite. The proportion by area of bainite in the entire metal structure is 42 to 85%, that of martensite is 15 to 50%, that of ferrite is 5% or less, and that of entire microstructure of the balance other than bainite, martensite and ferrite is 3% or less thereof. Furthermore, bainite has an average crystal grain diameter of 7 μm or less.

7 Claims, 1 Drawing Sheet

(51) Int. Cl.

| | |
|---|---|
| ***C21D 6/00*** | (2006.01) |
| ***C21D 9/46*** | (2006.01) |
| ***C22C 38/00*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |

(56) References Cited

FOREIGN PATENT DOCUMENTS

| | | | |
|---|---|---|---|
| JP | 2001-220641 | A | 8/2001 |
| JP | 2002-322539 | A | 11/2002 |
| JP | 2007-231369 | A | 9/2007 |
| KR | 10-2010-0016438 | A | 2/2010 |

OTHER PUBLICATIONS

U.S. Appl. No. 13/800,561, filed Mar. 13, 2013, Hamada, et al.

* cited by examiner

HIGH-YIELD-RATIO AND HIGH-STRENGTH STEEL SHEET EXCELLENT IN WORKABILITY

BACKGROUND OF THE INVENTION

1. Field of the Invention

The present invention relates to a high-yield-ratio and high-strength steel sheet (such as a cold rolled steel sheet, a hot-dip galvanized steel sheet, or an alloyed hot-dip galvanized steel sheet) excellent in workability. The invention relates particularly to a high-strength steel sheet having a tensile strength of 980 MPa or more and having a yield ratio heightened without being lowered in workability. The steel sheet of the invention is used suitably for, for example, members for household electric appliance, or structural members for automobiles (for example, body skeleton members such as a side sill, a pillar, a member, and reinforcing members; or strength members such as a bumper, a door guard, sheet members and suspension members), for which a high yield strength together with a high workability is required.

2. Description of Related Art

In recent automobiles, positive use has been made of a high-strength hot-dip galvanized steel sheet and a high-strength alloyed hot-dip galvanized steel sheet (these may be collectively called a galvanized steel sheet hereinafter) for, e.g., their car body skeleton members, their reinforcing members and others, for which rust prevention is required. These steel sheets are required not only to have an excellent spot-weldability and a good workability but also to have an energy absorbing performance when an automobile using the sheets collides, so as to be high in yield strength, that is, yield ratio.

From the viewpoint of an improvement in the spot-weldability, it is effective to reduce the C content by percentage therein. For example, JP 2007-231369A discloses the use of a steel sheet wherein the C content by percentage is remarkably reduced into a value less than 0.1%. Although the reduction of the C content by percentage gives excellent ductility and other workabilityies to the sheet, the sheet is decreased in yield strength. Thus, there remains a problem that the sheet cannot attain compatibility between high yield strength and workability.

JP 2002-322539A discloses a thin steel sheet consisting substantially of a matrix of a ferrite simplex structure containing less than 0.10% of C, and fine precipitations dispersed in the matric and having a particle diameter less than 10 nm, and having a tensile strength of 550 MPa or more, thereby being excellent in press-formability. However, according to working examples described in this patent application publication, the tensile strength of the thin steel sheet is at most from about 810 to 856 MPa. Thus, the publication never discloses a steel sheet having both of a high yield strength and an excellent workability even when the steel sheet has a high strength of 980 MPa or more.

In the meantime, a typical example of a steel sheet having high strength and workability together is a dual phase steel sheet (DP steel sheet) made mainly of ferrite having a high elongation and martensite exhibiting a high strength. However, the DP steel sheet can gain only a low yield ratio so that the sheet cannot attain compatibility between high yield ratio and high workability. As the DP steel sheet, for example, JP 55-122820A and JP 2001-220641A each disclose a high-strength hot-dip galvanized steel sheet excellent in strength-ductility balance and others. However, according to these precedent techniques, the generation of martensite is caused in a cooling step after hot dip galvanization or alloying treatment. Thus, at the time of martensitic transformation thereof, moving dislocation is introduced into ferrite, so that the steel sheet is declined in yield strength.

SUMMARY OF THE INVENTION

In light of the above-mentioned situation, the invention has been made, and an object thereof is to provide a steel sheet having a tensile strength of 980 MPa or more, and further exhibiting a high yield ratio and an excellent workability (specifically, an excellent TS-EL balance), and a method for manufacturing the steel sheet.

The invention for attaining the object is a steel sheet, which has a chemical composition comprising: C: 0.05% or more and less than 0.12% provided that the "%"s each mean "% by mass" and hereinafter the same matter is applied to any "%" described in connection with the chemical composition, Si: 0.1% or less, which is not 0%, Mn: 2.0 to 3.5%, at least one selected from the group consisting of Ti, Nb, and V: 0.01 to 0.2% in total, B: 0.0003 to 0.005%, P: 0.05% or less, S: 0.05% or less, Al: 0.1% or less, N: 0.015% or less, and Fe and one or more inevitable impurities as the balance of the composition; which has a metal structure comprising: bainite: 42 to 85%, martensite: 15 to 50%, ferrite: 5% or less, and entire microstructure of the balance of the metal structure other than bainite, martensite and ferrite: 3% or less provided that these proportions are each the proportion by area of one of these microstructures in the whole of the metal structure, and further satisfying a requirement that bainite has an average crystal grain diameter of 7 μm or less; and which has a tensile strength of 980 MPa or more.

In a preferred embodiment, the steel sheet comprises Cr and Mo in a total content by percentage of 1.0% or less.

The steel-sheet-manufacturing method according to the invention for attaining the object is a method for manufacturing the above-mentioned steel sheet, comprising the following steps to be conducted in the description order thereof: the step of preparing a steel having the above-mentioned composition; a soaking step of subjecting the steel to hot rolling and cold rolling, and then keeping the steel at a temperature ranging from the $Ac_3$ point of the steel to a temperature of (the $Ac_3$ point+150° C.) for 5 to 200 seconds; a cooling step of cooling the steel at an average cooling rate of 5° C./second, or more; and a low-temperature-keeping step of keeping the steel at a temperature ranging from the Ms point of the steel to a temperature of (the Ms point+50° C.) for 15 to 600 seconds.

According to the invention, basic elements of its metal structure are rendered bainite, martensite and ferrite (provided that none of ferrite may be contained), and the respective proportions by area of martensite and ferrite are appropriately controlled, and additionally the average crystal grain diameter of bainite is appropriately controlled to make it possible to yield a steel sheet which has a tensile strength of 980 MPa or more, a high yield ratio ([the yield strength]/[the tensile strength]×100=70% or more), and an excellent workability ([the tensile strength]×[the total elongation]=10.0 GPa·%, or more).

DESCRIPTION OF THE PREFERRED EMBODIMENTS

Figure 1:
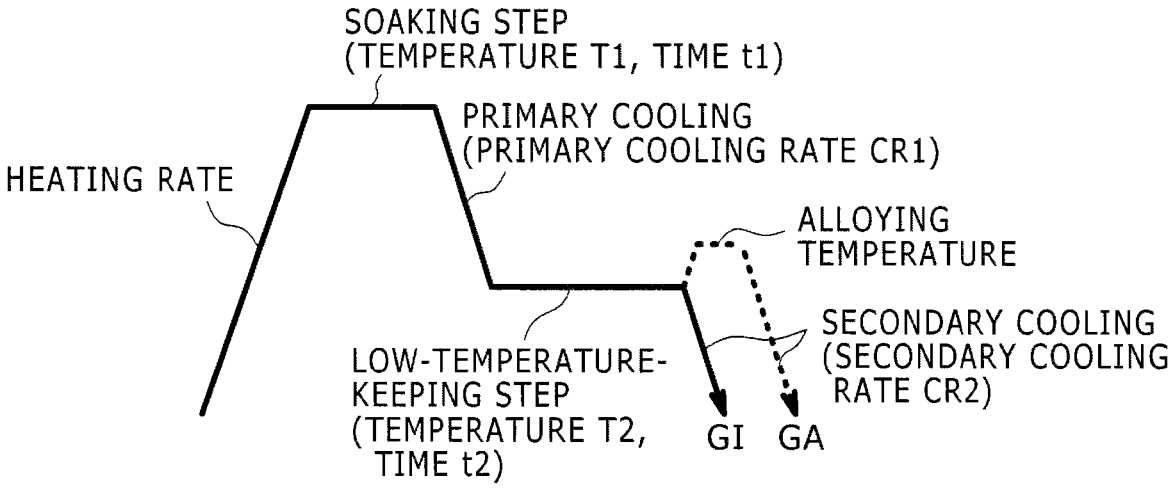
FIG. 1 is a chart showing an example of a heating pattern used when a steel sheet of the invention is manufactured.

The invention relates to a steel sheet that has a high strength of 980 MPa or more, and further has both of a high yield ratio and a high workability on a prerequisite condition that the C content by percentage in the sheet is set into a low range of values less than 0.12% from the viewpoint of spot-weldability. An outline of a process in which the above-described requirements have been gained is as follows:

As described above, it is desired from the viewpoint of spot-weldability to reduce the C content by percentage. However, about such a steel sheet having a low C content by percentage, no documents have hitherto disclosed that the steel sheet has a high strength of 980 MPa or higher, and further attains compatibility between a high yield strength and a good workability. In the meantime, a typical example of a steel sheet having both of strength and workability is a DP steel sheet made mainly of ferrite and martensite. However, about the DP steel sheet, at the time of martensitic transformation thereof, moving dislocation is introduced into ferrite so that the yield ratio thereof is unfavorably declined.

Thus, the inventors have set, as a basic concept, a matter that about a low-C steel sheet wherein the upper limit of the C content by percentage is 0.12%, ferrite in a conventional DP steel sheet which is this steel sheet is partially substituted with bainite, so that bainite and martensite are rendered a basic metal dual-microstructure (i.e., a dual-microstructure having a largest content by percentage) of this low-level-C steel sheet so that the content by percentage of ferrite is made into a small value, which may be zero, whereby the sheet attains a high yield ratio. However, the introduction of bainite makes ferrite relatively small in quantity to reduce the sheet in elongation with ease, and also makes martensite relatively small in quantity to reduce the sheet in strength with ease. Furthermore, if the proportion of martensite is made large, the sheet may be deteriorated in workability (balance of TS×EL). If the proportion of ferrite is relatively large, the sheet may not easily attain a high strength nor a high yield ratio. Thus, in order to attain all of a high strength, a high yield ratio and a high workability, the inventors have made eager researches about the respective proportions of martensite and ferrite to succeed in a matter that the proportions of these microstructures are decided into optimal ranges, respectively, thereby yielding a steel sheet having a high yield ratio, and ensuring a high balance between strength and workability. Furthermore, by making bainite minute in average crystal gain size, this balance has been further improved. In this way, the invention has been achieved.

In the present specification, the wording "excellent in workability" (about a steel sheet) means that the steel sheet is excellent in TS-EL (total elongation) balance in a high strength range that the tensile strength (TS) thereof is 980 MPa or more. Specifically, the wording denotes that in the high strength range, the expression of the tensile strength (TS; unit: MPa)×total elongation (EL; unit: %)≥$10.0\times10^3$ MPa·% (=10.0 GPa·%) is satisfied. It is preferred that TS×EL is 10.5 GPa·% or more.

In the specification, the wording "high yield ratio" or "high-yield-ratio" (about a steel sheet) means that the yield ratio (YR) of the steel sheet, which is represented by [the yield strength (YS)]/[the tensile strength (TS)]×100, is 70% or more. The YR is preferably 73% or more.

The steel sheet of the invention includes, in the category thereof, any cold rolled steel sheet, any hot-dip galvanized steel sheet, and any alloyed hot-dip galvanized steel sheet. In the specification, any hot-dip galvanized steel sheet and any alloyed hot-dip galvanized steel sheet, out of these sheets, is collectively referred to merely as a "galvanized steel sheet".

Hereinafter, requirements about the construction of the steel sheet according to the invention will be described. First, a detailed description will be made about microstructures by which the invention is characterized.

The steel sheet of the invention contains, in the metal structure thereof, bainite and martensite, and may further contain therein ferrite. The steel sheet may contain any microstructure of the balance other than bainite, martensite, and ferrite. In other words, as far as the steel sheet of the invention satisfies the respective proportions of the individual microstructures that will be detailed later, the steel sheet may be composed of only bainite and martensite (duplex structure), or of bainite, martensite and ferrite (triplex structure). Alternatively, the duplex structure and the triplex structure may each have any microstructure of the balance other than bainite, martensite and ferrite. Any one of these embodiments is included in the scope of the invention.

[Martensite Proportion: 15 to 50% by Area]

Martensite is a microstructure necessary for causing the steel sheet to ensure a high strength. In the invention, the proportion of martensite in the entire metal structure is set to 15% or more by area, preferably 20% or more by area. However, if the proportion of martensite is large, the elongation is declined so that the workability (the TS×EL balance) is deteriorated. Additionally, the proportion of bainite is decreased so that the effect of improving the yield ratio by bainite is not effectively exhibited. The upper limit thereof needs to be controlled into 50% by area, preferably 45% by area.

[Bainite]

Bainite is a microstructure contributing to an improvement in the yield ratio. Although bainite is lower in strength than martensite, bainite also has an effect of improving the steel sheet in ductility and other workabilities. In order to exhibit these effects based on bainite effectively without hindering the above-mentioned effect of martensite, the proportion by area of bainite in the entire metal structure needs only to be appropriately controlled in accordance with the whole of the metal structure. When the steel sheet of the invention is, for example, made only of martensite and bainite, the proportion of bainite is more than 42% by area and less than 85% by area. When the steel sheet of the invention is made only of martensite, bainite and ferrite, the proportion of bainite is more than 45% by area and less than 85% by area.

In the invention, either one of the proportion by area of martensite and that of bainite may be larger than the other. As far as these proportions satisfy the respective ranges of the microstructures specified in the invention, the manner about these proportions may be any one of the following: martensite>bainite; martensite=bainite; and martensite<bainite. Considering an improvement in the value of TS×EL, and others, preferred is the manner satisfying "martensite<bainite".

[Ferrite Proportion: 5% or Less by Area, which May Contain 0% by Area]

Although the steel sheet of the invention may be composed only of martensite and bainite, the steel sheet may contain ferrite in a proportion of 5% or less by area. Specifically, ferrite is a microstructure contributing to an improvement of the steel sheet in elongation properties. However, if the ferrite proportion is more than 5% by area, the steel sheet is declined in tensile strength and yield ratio. Thus, the upper limit thereof is set to 5% by area. A preferred proportion of ferrite is varied in accordance with the proportions of martensite and bainite, which are main microstructures, required properties (e.g., a property to which importance should be attached out of the yield ratio and the workability), and others. When it is desired to cause the steel sheet to exhibit a high yield ratio remarkably rather than workability, it is more preferred that the proportion of ferrite is smaller. The proportion of ferrite is preferably about 3% or less by area, most preferably 0% by area.

[Balance Microstructure Proportion: 3% or Less by Area, which May be 0% by Area]

As described above, the steel sheet of the invention may be composed only of (A) two phases of martensite and bainite, or only of (B) three phases of martensite, bainite, and ferrite. However, the two-phase (duplex) microstructure and the three-phase (triplex) microstructure may each contain any microstructure (any microstructure of the balance) generated inevitably in, for example, the process for manufacturing the steel sheet. Examples of the balance microstructure include pearlite, and retained austenite. The total proportion of the entire microstructure of the balance in the entire metal structure is preferably 3% or less by area.

It is advisable to make the identification of the above-mentioned microstructures and the measurement of the proportions thereof by methods demonstrated in working examples that will be described later.

[Average Crystal Grain Diameter of Bainite: 7 μm or Less]

In the invention, the respective proportions of the individual microstructures satisfy the above-mentioned requirement, and further the average crystal grain diameter of bainite is set to 7 μm or less. Crystal grains of bainite each mean a crystal grain surrounded by a large-inclination-angle grain boundary considered to correspond to a prior austenite boundary. By making the grain diameter of bainite minute in this way, the TS×EL balance is further improved. This effect is more effectively exhibited as the average crystal grain diameter of bainite is smaller. The average crystal grain diameter is preferably 6 μm or less, more preferably 5 μm or less. The lower limit thereof is not limited in light of a relationship thereof with the effect. Considering the chemical composition in the invention, the manufacturing method of the invention, and others, the limit is preferably about 1 μm. The average crystal grain diameter of bainite may be measured by a method demonstrated in the working examples, which will be described later.

As described above, in the invention, about bainite, the average crystal grain diameter thereof is specified; it is preferred to make martensite also as minute as bainite. In this manner, the effect of improving the TS×EL balance based on the control of the average crystal grain diameter of bainite is more effectively exhibited. The reason why only the average crystal grain diameter of in particular bainite is specified in the invention is based on a matter that in the steel sheet of the invention, it is preferred that bainite is contained to occupy the largest proportion; and is further that when the average crystal grain diameter of bainite is minute, the average crystal grain diameter of martensite is inevitably made minute.

The above has described the structure of the steel sheet according to the invention.

In order that the steel sheet of the invention has the above-mentioned structure, whereby the sheet can exhibit excellent properties (high strength, yield ratio and workability) and further exhibit other properties such as spot-weldability and plating (or galvanizing) adhesiveness, it is necessary to control the chemical composition of the steel sheet as will be detailed hereinafter.

[C: 0.05% or More, and Less than 0.12%]

C is an element necessary for ensuring the strength of the steel sheet. If the content by percentage (referred to merely as the content hereinafter) C is short, ferrite is unfavorably generated in a large proportion and further bainite and martensite are softened so that the steel sheet does not easily attain a high yield ratio nor a high strength. Thus, in the invention, the C content is determined to be 0.05% or more. The C content is preferably 0.07% or more. On the other hand, if C is excessively contained, the spot-weldability is deteriorated. Thus, the upper limit of the C content is 0.12%, preferably 0.11%.

[Si: 0.1% or Less]

Si is effective for the solid-solution strengthening of ferrite. However, Si is an element deteriorating the steel sheet in spot-weldability and plating adhesiveness. Thus, in the invention, the Si content is preferably made as much as small. The upper limit of the Si content is preferably 0.1%, preferably 0.07%, more preferably 0.05%.

[Mn: 2.0 to 3.5%]

Mn is an element for improving the steel sheet in hardenability to contribute to ensure a high strength thereof. If the Mn content is short, the hardenability is insufficient and ferrite is generated in a large proportion so that the sheet does not easily attain a high strength nor a high yield ratio. Thus, in the invention, Mn is incorporated in a content of 2.0% or more. The lower limit of the Mn content is preferably 2.3%, more preferably 2.5%. On the other hand, if Mn is excessively contained, bainite transformation is restrained so that the strength-elongation balance is lowered and the weldability is easily deteriorated. Thus, the upper limit of Mn is set to 3.5%. The upper limit of the Mn content is preferably 3.2%, more preferably 2.9%.

[At Least One Element Selected from the Group Consisting of Ti, Nb and V: 0.01 to 0.2% in Total]

Ti, Nb and V are each an element for producing a flux pinning effect based on the precipitation of a carbonitride to make austenite crystal grains minute when the steel sheet is heated, thereby making ferrite, bainite and martensite, which are transformation microstructures from austenite, minute to contribute to an improvement in the strength-elongation balance. These elements may be added alone, or in combination of two or more thereof. In order to exhibit such an advantageous effect sufficiently, the lower limit of the total content thereof, which means the following in a case where one of these elements is contained alone: the content of the one (hereinafter, the same meaning is applied to the same case), is preferably 0.01%, more preferably 0.02%. However, if the total content is large, the steel sheet may be unfavorably increased in deformation resistance, and deteriorated in productivity when hot-rolled and cold-rolled, and is increased in cost. Moreover, even when the element(s) is/are excessively contained, the above-mentioned effect is saturated. Considering these matters, the total content is set to 0.2% or less. The upper limit thereof is preferably 0.15%.

[B: 0.0003 to 0.005%]

B is an element for improving the steel sheet in hardenability to contribute to the securement of a high strength thereof. B also has an effect of restraining the generation of ferrite to restrain the steel sheet from being decreased in tensile strength and yield ratio by the generation of ferrite in a large proportion. In order to exhibit such advantageous effects, the lower limit of the B content is set to 0.0003%, preferably 0.0005%. However, if B is excessively contained, the steel sheet is increased in hot deformation resistance to be deteriorated in productivity. Thus, the upper limit thereof is set to 0.005%, preferably 0.0035%.

[P: 0.05% or Less]

P is an element effective for the solid-solution strengthening of ferrite. However, P is an element decreasing the spot-weldability or the plating adhesiveness, so that the content thereof is preferably as small as possible. Thus, the upper limit of the P content is set to 0.05%, preferably 0.03%.

[S: 0.05% or Less]

S is an inevitable impurity element. The P content is preferably made as small as possible to ensure the workability and the spot-weldability. Thus, the upper limit thereof is set to 0.05%, preferably 0.02%, more preferably 0.01%.

[Al: 0.1% or Less]

Al is an element having an acid-removing effect. In order to exhibit this effect, the lower limit of the Al content is set to 0.005%. However, even when Al is excessively incorporated, the effect is saturated. Thus, the upper limit of the Al content is set to 0.1%, preferably 0.08%, more preferably 0.06%.

[N: 0.015% or Less]

N is an inevitable impurity element. If N is contained in a large proportion, the steel sheet tends to be deteriorated in toughness and ductility (elongation). Thus, the upper limit of the N content is set to 0.015%, preferably 0.01%, more preferably 0.005%.

Basic components of the steel used in the invention are as described above. The balance is made of iron and one or more inevitable impurities. Examples of the impuriti(es), which is/are taken in dependently on the raw material, the resource, the manufacturing facilities and others, O and tramp elements (such as Sn, Zn, Pb, As, Sb, and Bi) besides S and N, which have been described above.

If necessary, the steel used in the invention may further contain optional elements described below.

[Cr, and Mo: 1.0% or Less in Total]

Cr and Mo are each an element for improving the steel in hardenability to ensure a high strength thereof. In the invention, these elements may be added alone or in combination. In order to exhibit this advantageous effect, the lower limit of the total content thereof, which means the following in a case where one of these elements is contained alone: the content of the one (hereinafter, the same meaning is applied to the same case), is preferably 0.04%. However, if Cr and/or Mo is/are excessively contained, the ductility (elongation) is deteriorated. Thus, the upper limit of the total content is set preferably to 1.0%, more preferably to 0.40%.

The following will describe a method for manufacturing the above-mentioned steel sheet.

The method, which is the steel-sheet-manufacturing method according to the invention, includes the following steps to be conducted in the description order thereof: the step of preparing a steel having the above-mentioned composition; a soaking step of subjecting the steel to hot rolling and cold rolling, and then keeping the steel at a temperature ranging from the $Ac_3$ point of the steel to a temperature of (the $Ac_3$ point+150° C.) for 5 to 200 seconds; a cooling step of cooling the steel at an average cooling rate of 5° C./second, or more; and a low-temperature-keeping step of keeping the steel at a temperature ranging from the Ms point of the steel to a temperature of (the Ms point+50° C.) for 15 to 600 seconds. The $Ac_3$ point denotes the temperature at which the transformation of the steel sheet into austenite is finished when the steel is heated, and the Ms point denotes the temperature at which the martensitic transformation of the steel is started.

Figure 2:
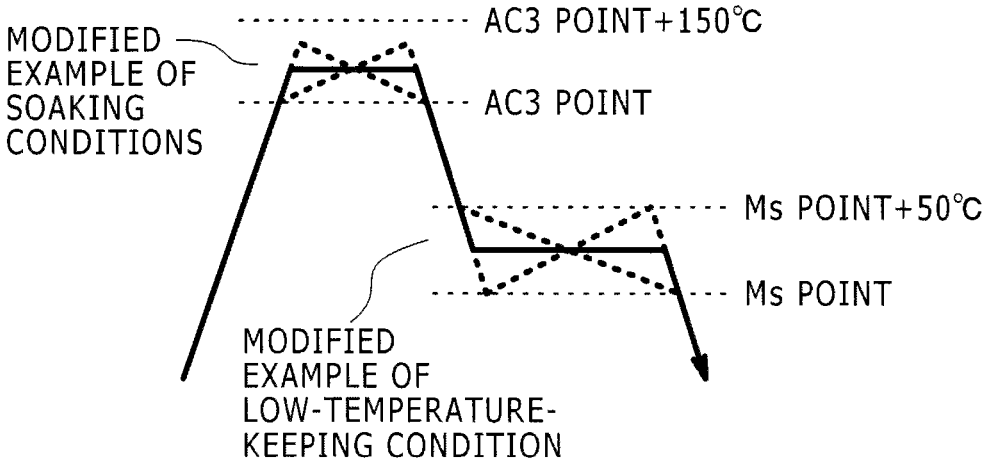
FIG. 2 is a chart showing a modified example of the heating pattern used when the steel sheet of the invention is manufactured.

In this manufacturing method, it is very important to control, in particular, the annealing process after the cold rolling appropriately. Referring to FIGS. 1 and 2, a detailed description will be made hereinafter about the annealing process by which the invention is characterized. FIG. 1 is a chart showing a heating pattern for conducing each of the soaking step and the low-temperature-keeping step at a constant temperature. FIG. 2 is a chart showing a heating pattern for conducing each of the soaking step and the low-temperature-keeping step at a temperature which is varied within a scope in which the requirements of the invention are satisfied.

Prepared is first a steel having the above-mentioned composition.

Next, the steel is subjected to hot rolling and cold rolling in a usual way. About, for example, the hot rolling, the finish rolling temperature of the steel may be set to about the $Ac_3$ point, or higher, and the winding temperature thereof may be set to about 400 to 700° C.

After the hot rolling, the steel is washed with an acid if necessary, and then subjected to cold rolling into a cold rolling ratio of about 35 to 80%.

Next, the steel is subjected to the following annealing process:

First, the steel is heated from room temperature to a soaking temperature T1 within a temperature range from the $Ac_3$ point to (the $Ac_3$ point+150° C.). As will also be described, the invention is characterized by specifying the soaking temperature T1. From room temperature to the soaking temperature T1, the average heating rate is not particularly limited, and it is advisable to control the rate appropriately within an ordinarily usable range. In the invention, within the temperature range, the steel is heated preferably at an average heating rate of 1° C./second or more, more preferably 2° C./second or more, considering the productivity of the steel sheet, and others.

[Soaking Step of Keeping the Steel at the Soaking Temperature T1 within the Temperature Range from the $Ac_3$ Point to (the $Ac_3$ Point+150° C.) for a Soaking Time t1 of 5 to 200 Seconds]

Next, the steel is soaked at the soaking temperature T1 within the temperature range from the $Ac_3$ point to (the $Ac_3$ point+150° C.) for a soaking time t1 of 5 to 200 seconds. If the soaking temperature T1 is lower than the $Ac_3$ point, the austenite transformation becomes insufficient so that ferrite remains in a large proportion. Thus, it is difficult that the steel ensures a desired structure. Moreover, processing strain remains easily in ferrite so that an excellent elongation property based on ferrite is not effectively exhibited with ease. The soaking temperature T1 is preferably (the $Ac_3$ point+10° C.) or higher. On the other hand, if the soaking temperature T1 is higher than (the $Ac_3$ point+150° C.), the grain growth of austenite is promoted so that the microstructure of bainite or martensite is made coarse. Thus, the average crystal grain diameter of this microstructure becomes large so that the strength-elongation balance is unfavorably declined. The soaking temperature T1 is preferably (the $Ac_3$ point+100° C.) or lower.

The soaking time t1 is set into the range from 5 to 200 seconds. If the time is less than 5 seconds, the austenite transformation becomes insufficient so that ferrite remains in a large proportion. Thus, it is difficult that the steel ensures a desired structure. Moreover, processing strain may remain in ferrite so that an excellent elongation property based on ferrite may not be effectively exhibited with ease. The time is preferably 20 seconds or more. On the other hand, if the soaking time t1 is too long, the grain growth of austenite is promoted so that the microstructure is made coarse as described above. As a result, the strength-elongation balance is easily declined. Thus, the soaking time t1 is set to 200 seconds or less.

The soaking temperature T1 does not need to be a constant temperature. As far as the soaking time t1 for the soaking within the temperature range from the $Ac_3$ point to (the $Ac_3$ point+150° C.) is ensured for 5 to 200 seconds, the soaking temperature T1 may be varied as shown in FIG. 2. Specifically, it is allowable, for example, to raise the temperature of the steel at a stretch up to a temperature within the temperature range from the $Ac_3$ point to (the $Ac_3$ point+150° C.), and then keep the steel isothermally at this temperature for 5 to 200 seconds, or to raise the steel temperature into the temperature range from the $Ac_3$ point to (the $Ac_3$ point+150° C.) and further raise the temperature within this temperature range or reversely lower the temperature within the temperature range. In other words, any embodiment wherein the soaking time t1 for the soaking within the above-mentioned temperature range for T1 is ensured over a period in the given range is included in the scope of the invention. The embodiment can attain desired properties.

[Cooling Step of Cooling the Steel from T1 to a Temperature T2 within a Temperature Range from the Ms Point to (the Ms Point+50° C.) at an Average Cooling Rate (CR1) of 5° C./Second or More]

In order for the steel to satisfy the above-mentioned proportion of ferrite, the steel is cooled from T1 to a temperature T2 within a temperature range from the Ms point to (the Ms point+50° C.), and the average cooling rate (CR1) in this case is set to 5° C./second or more. If the average cooling rate CR1 is less than 5° C./second, ferrite transformation advances so that the proportion of ferrite is not easily controlled into 5% or less. Thus, the steel does not easily ensure a high strength nor a high yield ratio. The average cooling rate CR1 is preferably 10° C./second or more. The upper limit of the average cooling rate CR1 is not particularly limited from the above-mentioned viewpoint. Considering a precision-deterioration in the control of a temperature at which the cooling is stopped, the temperature inside the coil (concerned), and others, the upper limit is preferably 100° C./second as an upper limit realizable in an actual production line.

It is not necessarily essential to conduct the cooling from T1 to T2, within the temperature range from the Ms point to (the Ms point+50° C.), at a constant rate. Thus, the cooling may be conducted at divided stages. In short, within the temperature range from T1 to T2, the average cooling rate needs only to be 5° C./second or more. It is allowable, for example, to conduct the cooling within the temperature range at two stages different from each other in average cooling rate, and make a primary cooling rate (CR11) for cooling from T1 to a middle temperature (for example, a temperature between 500 and 700° C.) different from a secondary cooling rate (CR12) for cooling from the middle temperature to T2.

[Low-temperature-keeping Step of Keeping the Steel at the Temperature T2, which is Also Called the Low-keeping Temperature T2, within the Low-temperature-keeping Temperature Range from the Ms Point to (the Ms Point+50° C.) for a Low-Temperature-Keeping Time t2 of 15 to 600 Seconds]

After the steel is cooled to the low-keeping temperature T2 at the average cooling rate (CR1), the steel is kept within the low-temperature-keeping temperature range (or at the temperature T2) for a low-temperature-keeping time t2 of 15 to 600 seconds. In this manner, bainite transformation advances so that the steel can ensure bainite and martensite to have the respective predetermined proportions. If the low-temperature-keeping temperature T2 is lower than the Ms point, the proportion of martensite is increased. On the other hand, if the low-temperature-keeping temperature T2 is higher than (the Ms point+50° C.), bainite transformation is not easily caused so that the proportion of martensite is increased, as well. The low-temperature-keeping temperature T2 is preferably from (the Ms point+5° C.) to (the Ms point+45° C.) both inclusive.

The low-temperature-keeping time t2 is set into the range from 15 to 600 seconds. If the low-temperature-keeping time t2 is less than 15 seconds, bainite transformation is not sufficiently caused so that the proportion of martensite is increased. Thus, the steel does not easily gain a desired structure. The time t2 is preferably 20 seconds or more. On the other hand, if the low-temperature-keeping time t2 is more than 600 seconds, bainite transformation advances no more so that the steel is deteriorated in productivity. Thus, the upper limit of the low-temperature-keeping time t2 is set to 600 seconds, preferably 500 seconds.

The low-temperature-keeping temperature T2 does not need to be a constant temperature. As far as the time for keeping the steel within the temperature range from the Ms point to (the Ms point+50° C.) is ensured for 15 to 600 seconds when the steel is cooled from the soaking temperature T1, the temperature T2 may be changed as shown in FIG. 2. Specifically, it is allowable, for example, to cool the steel at a stretch from the soaking temperature T1 to the low-temperature-keeping temperature T2 and then keep the steel isothermally at this temperature, or to cool the steel to the low-temperature-keeping temperature T2, and then cool the steel further within the low-temperature-keeping temperature range or then heat the steel further within this temperature range. In other words, any embodiment wherein the low-temperature-keeping time t2 within the low-temperature-keeping temperature range for T2 is ensured over a period in the given range is included in the scope of the invention. The embodiment can attain desired properties.

Next, the steel is cooled from the low-temperature-keeping temperature T2 within the temperature range from the Ms point to (the Ms point+50° C.) to room temperature to manufacture the high-strength steel sheet (cold rolled steel sheet) of the invention. As described above, the invention is characterized by specifying the low-temperature-keeping temperature T2; thus, in the temperature range from the low-temperature-keeping temperature T2 to room temperature, the average cooling rate is not particularly limited. It is therefore advisable to control the rate appropriately within an ordinarily used range. In the invention, it is preferred to cool the steel at an average cooling rate of 1° C./second or more in this temperature range. If the average cooling temperature is less than 1° C./second, the steel is declined in productivity, and further martensite undergoes austempering so that martensite is softened. Thus, the steel may be declined in TS. The average cooling rate is more preferably 3° C./second or more.

A hot-dip galvanization layer or an alloyed hot-dip galvanization layer may be formed on a surface of the high-strength steel sheet. Conditions for forming the hot-dip galvanization layer or the alloyed hot-dip galvanization layer are not particularly limited. An ordinary hot-dip galvanizing treatment or an ordinary alloying treatment may be adopted. In such a way, the hot-dip galvanized steel sheet (GI) and the alloyed hot-dip galvanized steel sheet (GA) of the invention are obtained.

Specifically, a desired galvanized steel sheet can be obtained by conducting a hot-dip galvanizing treatment, or conducting an alloying treatment in addition thereto in one of the steps in FIG. 1 (or between two of the steps), for example, in the middle of the low-temperature-keeping step, between the low-temperature-keeping step and the subsequent secondary cooling step, or in the middle of the secondary cooling step. When the hot-dip galvanizing treatment, or the alloying treatment is conducted in the middle of the low-temperature-keeping step, it is necessary to adjust, into the range from 15 to 600 seconds, the total of the times for keeping the steel within the low-temperature-keeping temperature range for T2, the keeping times being before and after the treatment.

Conditions for the galvanizing treatment and the alloying treatment are not particularly limited, and may be ordinarily usable conditions. Under an example of conditions for manufacturing, for example, a hot-dip galvanized steel sheet, the steel sheet of the invention is immersed in a galvanizing solution having a temperature adjusted to about 430 to 500° C. to be subjected to hot-dip galvanization, and subsequently cooled. Under an example of conditions for manufacturing an alloyed hot-dip galvanized steel sheet, after the hot-dip galvanization the hot-dip galvanized steel sheet is heated to a temperature of about 500 to 750° C., and then alloyed and cooled.

EXAMPLES

Hereinafter, the invention will be more specifically described by way of working examples and comparative examples. However, the invention is not limited by the working examples. The working examples may be modified within a scope consistent with the subject matters of the invention described above or below, and the modified examples may be carried out. The examples are included in the technical scope of the invention.

Example 1

Including Working Examples and Comparative Examples

Respective ingots of steels having various chemical compositions shown in Table 1 were manufactured, and the ingots were each hot-rolled into a thickness of 2.4 mm. At the time, the finish rolling temperature and the rolling temperature were set to 880° C. and 600° C., respectively. Next, the resultant hot-rolled steel sheets were washed with an acid, and then cold-rolled into a thickness of 1.2 mm (cold rolling ratio: 50%).

Next, the steel sheets were annealed in a galvanization-continued annealing line under respective annealing conditions shown in Table 2, and then manufactured into hot-dip galvanized steel sheets (GI) at a galvanizing bath temperature of 450° C., or into alloyed hot-dip galvanized steel sheets (GA) by holding the hot-dip galvanized steel sheets at 550° C. for 25 sec after the galvanizing.

For equations for calculating the Acs points and the Ms point in Table 1, reference was made to "The Physical Metallurgy of Steels, Leslie (translated and supervised by Shigeyasu Koda)", Marzen Co., Ltd., published in 1985, p. 273 (about the $Ac_3$ point), and p. 231 (about the Ms point). Details thereof are as follows:

$$\text{the } Ac_3 \text{ point} = 910 - 203\times\sqrt{[C]} - 15.2\times[Ni] + 44.7\times[Si] + 104\times[V] + 31.5\times[Mo] + 13.1\times[W] - 30\times[Mn] - 11\times[Cr] - 20\times[Cu] + 700\times[P] + 400\times[Al] + 120[As] + 400[Ti], \text{ and}$$

$$\text{the Ms point} = 561 - 474\times[C] - 33\times[Mn] - 17\times[Ni] - 17\times[Cr] - 21\times[Mo]$$

wherein the number in each parenthesis-pair [ ] represents the content by percentage (% by mass) of an element inside the parentheses. When the element is not contained in the steel in question, the calculation is made under the condition that the content by percentage of the element is 0.

About each of the steel sheets yielded as described above, a tensile test was made as described below, and mechanical properties thereof were measured and further the structure thereof was observed descried below.

[Mechanical Property Measurement]

From each of the cold-rolled steel sheets, a #5 test piece according to JIS Z2201 was sampled out to have a longitudinal direction along the rolled direction thereof, and measured about the yield strength YS, the tensile strength TS, the uniform elongation (UEL), and total elongation (EL) according to JIS Z2241. From these values, the yield ratio YR [(YS/TS)×100] was calculated.

Out of the steels of Example 1, any steel satisfying TS≥980 MPa was estimated to be high in strength, and any steel satisfying YR≥70% was estimated to be high in yield ratio. About EL, any steel satisfying TS×EL≥10.0 GPa·% was estimated to be excellent in strength-elongation balance (TS-EL balance).

[Structure Observation (Microstructure Observation)]

In order to observe a t/4-position (t: sheet thickness) of a cross section perpendicular to the rolling direction of each of the cold steel sheets, the steel sheet was etched with Knightal to cause the structure thereof to make its appearance. The structure was observed through a scanning electron microscope (SEM).

Specifically, the respective proportions by area of ferrite and martensite (abbreviated to VF and VM, respectively, in Table 3 described later) were each measured by image analysis using a sectional structure photograph taken under magnifications (of 1,000, 1,500 or 3,000) corresponding to the sizes of crystal grains of the structure. The proportions by area were each gained as the average of values of 5 visual fields of the section. The size of each of the visual fields was 75 μm×75 μm under the 1,000 magnifications, 50 μm×50 μm under the 1,500 magnifications, and 25 μm×25 μm under the 3,000 magnifications. In present Example, no microstructures of the balance, such as pearlite, were observed. Thus, the proportion by area of bainite (abbreviated to VB in Table 3) was calculated by subtracting the respective proportions by area of ferrite and martensite, which were measured as described above, from the proportion (100%) by area of the entire structure.

The average crystal grain diameter of bainite (abbreviated to dB in Table 3) was obtained by measuring the average crystal grain size of bainite by a cutting method according to "Method for Testing Ferrite Crystal Grain Size of Ferrite in Steel" prescribed in JIS G 0552.

TABLE 1

| Steel | Chemical composition (% by mass), *The balance is composed of iron and inevitable impurities. | | | | | | | | | | | | | $Ac_3$ point | Ms point | $Ac_3$ point | Ms point +50 |
|---|---|---|---|---|---|---|---|---|---|---|---|---|---|---|---|---|---|
| No. | C | Si | Mn | P | S | Al | N | Cr | Mo | Ti | Nb | V | B | (° C.) | (° C.) | +150 (° C.) | (° C.) |
| A | 0.098 | 0.01 | 2.89 | 0.005 | 0.001 | 0.04 | 0.003 | 0.00 | 0.00 | 0.060 | 0.000 | 0.000 | 0.0026 | 803 | 419 | 953 | 469 |
| B | 0.088 | 0.01 | 2.74 | 0.006 | 0.002 | 0.03 | 0.002 | 0.35 | 0.00 | 0.041 | 0.000 | 0.000 | 0.0025 | 798 | 423 | 948 | 473 |
| C | 0.089 | 0.02 | 2.75 | 0.004 | 0.002 | 0.05 | 0.002 | 0.00 | 0.30 | 0.041 | 0.000 | 0.000 | 0.0025 | 818 | 422 | 968 | 472 |
| D | 0.081 | 0.01 | 2.61 | 0.008 | 0.003 | 0.05 | 0.003 | 0.25 | 0.15 | 0.055 | 0.000 | 0.000 | 0.0012 | 826 | 429 | 976 | 479 |
| E | 0.080 | 0.01 | 2.60 | 0.007 | 0.004 | 0.05 | 0.003 | 0.26 | 0.15 | 0.056 | 0.000 | 0.000 | 0.0023 | 825 | 430 | 975 | 480 |
| F | 0.105 | 0.02 | 2.21 | 0.006 | 0.002 | 0.05 | 0.002 | 0.00 | 0.00 | 0.060 | 0.000 | 0.000 | 0.0025 | 826 | 438 | 976 | 488 |
| G | 0.061 | 0.02 | 3.31 | 0.005 | 0.003 | 0.03 | 0.002 | 0.00 | 0.00 | 0.061 | 0.000 | 0.000 | 0.0025 | 802 | 423 | 952 | 473 |
| H | 0.082 | 0.02 | 3.01 | 0.009 | 0.001 | 0.05 | 0.002 | 0.00 | 0.00 | 0.025 | 0.000 | 0.000 | 0.0006 | 800 | 423 | 950 | 473 |
| I | 0.042 | 0.04 | 2.91 | 0.006 | 0.003 | 0.03 | 0.003 | 0.00 | 0.00 | 0.061 | 0.000 | 0.000 | 0.0027 | 825 | 445 | 975 | 495 |

TABLE 1-continued

| Steel | Chemical composition (% by mass), *The balance is composed of iron and inevitable impurities. | | | | | | | | | | | | | $Ac_3$ point | Ms point | $Ac_3$ point | Ms point +50 |
|---|---|---|---|---|---|---|---|---|---|---|---|---|---|---|---|---|---|
| No. | C | Si | Mn | P | S | Al | N | Cr | Mo | Ti | Nb | V | B | (° C.) | (° C.) | +150 (° C.) | (° C.) |
| J | 0.097 | 0.02 | 1.87 | 0.005 | 0.002 | 0.06 | 0.002 | 0.00 | 0.00 | 0.060 | 0.000 | 0.000 | 0.0026 | 841 | 453 | 991 | 503 |
| K | 0.097 | 0.01 | 2.91 | 0.005 | 0.002 | 0.04 | 0.002 | 0.00 | 0.00 | 0.000 | 0.000 | 0.000 | 0.0038 | 781 | 419 | 931 | 469 |
| L | 0.098 | 0.02 | 2.90 | 0.005 | 0.001 | 0.04 | 0.002 | 0.00 | 0.00 | 0.059 | 0.000 | 0.000 | 0.0000 | 801 | 419 | 951 | 469 |
| M | 0.082 | 0.03 | 3.05 | 0.009 | 0.003 | 0.03 | 0.004 | 0.00 | 0.00 | 0.138 | 0.000 | 0.000 | 0.0024 | 836 | 421 | 986 | 471 |
| N | 0.090 | 0.02 | 2.92 | 0.008 | 0.003 | 0.03 | 0.004 | 0.00 | 0.00 | 0.000 | 0.097 | 0.000 | 0.0026 | 781 | 422 | 931 | 472 |
| O | 0.091 | 0.01 | 2.91 | 0.010 | 0.001 | 0.04 | 0.003 | 0.00 | 0.00 | 0.032 | 0.048 | 0.000 | 0.0027 | 798 | 422 | 948 | 472 |
| P | 0.069 | 0.02 | 3.11 | 0.007 | 0.002 | 0.03 | 0.003 | 0.00 | 0.00 | 0.000 | 0.000 | 0.071 | 0.0021 | 789 | 426 | 939 | 476 |
| Q | 0.098 | 0.03 | 3.63 | 0.005 | 0.001 | 0.030 | 0.004 | 0.00 | 0.00 | 0.061 | 0.000 | 0.000 | 0.0025 | 779 | 395 | 929 | 445 |

TABLE 2

| Execution No. | Steel No. | Heating rate (° C./sec) | Soaking conditions Temperature T1 (° C.) | Soaking conditions Time t1 (sec) | Primary cooling rate CR1 (° C.) | Low-temperature-keeping conditions Temperature T2 (° C.) | Low-temperature-keeping conditions Time t2 (sec) | Alloying conditions Temperature (° C.) | Alloying conditions Time (sec) | Secondary cooling rate CR2 (° C./sec) | Galvanization classification |
|---|---|---|---|---|---|---|---|---|---|---|---|
| 1 | A | 12 | 850 | 50 | 15 | 450 | 40 | — | — | 6 | GI |
| 2 | B | 16 | 850 | 38 | 20 | 450 | 30 | — | — | 8 | GI |
| 3 | C | 16 | 850 | 38 | 20 | 450 | 30 | — | — | 8 | GI |
| 4 | D | 12 | 850 | 50 | 15 | 450 | 40 | — | — | 6 | GI |
| 5 | E | 12 | 850 | 50 | 15 | 450 | 40 | — | — | 6 | GI |
| 6 | F | 20 | 850 | 30 | 25 | 450 | 24 | — | — | 10 | GI |
| 7 | G | 12 | 850 | 50 | 15 | 450 | 40 | — | — | 6 | GI |
| 8 | H | 16 | 850 | 50 | 20 | 450 | 30 | — | — | 8 | GI |
| 9 | A | 12 | 775 | 50 | 15 | 450 | 40 | — | — | 6 | GI |
| 10 | A | 12 | 1000 | 50 | 15 | 450 | 40 | — | — | 6 | GI |
| 11 | A | 12 | 850 | 50 | 3 | 450 | 40 | — | — | 6 | GI |
| 12 | A | 12 | 850 | 50 | 15 | 400 | 40 | — | — | 6 | GI |
| 13 | A | 12 | 850 | 50 | 15 | 500 | 40 | — | — | 6 | GI |
| 14 | A | 12 | 850 | 50 | 15 | 450 | 10 | — | — | 6 | GI |
| 15 | A | 12 | 850 | 50 | 15 | 450 | 500 | — | — | 6 | GI |
| 16 | I | 16 | 850 | 38 | 20 | 460 | 30 | — | — | 6 | GI |
| 17 | J | 20 | 850 | 30 | 25 | 460 | 24 | — | — | 10 | GI |
| 18 | K | 12 | 850 | 50 | 15 | 450 | 40 | — | — | 6 | GI |
| 19 | L | 12 | 850 | 50 | 15 | 450 | 40 | — | — | 6 | GI |
| 20 | M | 16 | 900 | 38 | 20 | 450 | 30 | — | — | 8 | GI |
| 21 | N | 20 | 850 | 30 | 25 | 450 | 24 | — | — | 10 | GI |
| 22 | O | 16 | 850 | 38 | 20 | 450 | 30 | — | — | 8 | GI |
| 23 | P | 20 | 820 | 30 | 25 | 450 | 24 | — | — | 6 | GI |
| 24 | A | 12 | 850 | 3 | 15 | 450 | 40 | — | — | 6 | GI |
| 25 | A | 12 | 850 | 300 | 15 | 450 | 40 | — | — | 6 | GI |
| 27 | Q | 20 | 850 | 30 | 25 | 420 | 24 | — | — | 10 | GI |
| 28 | A | 16 | 880 | 38 | 20 | 450 | 30 | 550 | 22 | 8 | GA |
| 29 | D | 16 | 880 | 38 | 20 | 450 | 30 | 550 | 22 | 8 | GA |

TABLE 3

| Execution No. | Steel No. | Microstructure observed results VF (%) | VM (%) | VB (%) | dB (μm) | Tensile execution results YS (MPa) | TS (MPa) | YR (%) | EL (%) | UEL (%) | TS × EL (GPa · %) |
|---|---|---|---|---|---|---|---|---|---|---|---|
| 1 | A | 0 | 39 | 61 | 3.7 | 792 | 1044 | 75.9 | 10.6 | 6.0 | 11.1 |
| 2 | B | 1 | 32 | 67 | 5.1 | 743 | 1018 | 73.0 | 10.5 | 5.7 | 10.7 |
| 3 | C | 0 | 36 | 64 | 4.9 | 797 | 1044 | 76.3 | 10.4 | 5.7 | 10.9 |
| 4 | D | 3 | 25 | 72 | 4.2 | 747 | 1005 | 74.3 | 12.5 | 6.4 | 12.6 |
| 5 | E | 0 | 41 | 59 | 4.0 | 842 | 1091 | 77.2 | 10.8 | 5.4 | 11.8 |
| 6 | F | 3 | 22 | 75 | 3.5 | 714 | 998 | 71.5 | 12.8 | 6.6 | 12.8 |
| 7 | G | 0 | 46 | 54 | 4.6 | 810 | 1032 | 78.5 | 10.1 | 5.4 | 10.4 |
| 8 | H | 2 | 24 | 74 | 6.6 | 788 | 1012 | 77.9 | 10.2 | 5.2 | 10.3 |
| 9 | A | 12 | 45 | 43 | 2.8 | 632 | 957 | 66.0 | 15.2 | 8.2 | 14.5 |
| 10 | A | 0 | 27 | 73 | 9.8 | 878 | 1041 | 84.3 | 8.6 | 4.9 | 9.0 |
| 11 | A | 7 | 43 | 50 | 3.5 | 655 | 962 | 68.1 | 14.3 | 7.9 | 13.8 |

TABLE 3-continued

| Execution No. | Steel No. | Microstructure observed results VF (%) | VM (%) | VB (%) | dB (μm) | Tensile execution results YS (MPa) | TS (MPa) | YR (%) | EL (%) | UEL (%) | TS × EL (GPa · %) |
|---|---|---|---|---|---|---|---|---|---|---|---|
| 12 | A | 0 | 57 | 43 | 3.3 | 889 | 1066 | 83.4 | 8.9 | 5.2 | 9.5 |
| 13 | A | 0 | 65 | 35 | 4.1 | 840 | 1089 | 77.1 | 8.8 | 5.3 | 9.6 |
| 14 | A | 0 | 75 | 25 | 3.8 | 851 | 1137 | 74.8 | 8.2 | 4.7 | 9.3 |
| 15 | A | 0 | 30 | 70 | 3.6 | 789 | 1010 | 78.1 | 11.5 | 6.4 | 11.6 |
| 16 | I | 0 | 44 | 56 | 3.8 | 722 | 925 | 78.1 | 11.7 | 5.7 | 10.8 |
| 17 | J | 10 | 27 | 63 | 3.4 | 623 | 911 | 68.4 | 16.1 | 8.5 | 14.7 |
| 18 | K | 0 | 25 | 75 | 7.7 | 851 | 1024 | 83.1 | 9.2 | 5.1 | 9.4 |
| 19 | L | 14 | 35 | 51 | 3.5 | 576 | 889 | 64.8 | 16.6 | 8.8 | 14.8 |
| 20 | M | 2 | 27 | 71 | 2.4 | 790 | 1018 | 77.6 | 12.9 | 6.8 | 13.1 |
| 21 | N | 1 | 36 | 63 | 2.7 | 769 | 1040 | 73.9 | 12.5 | 6.5 | 13.0 |
| 22 | O | 0 | 40 | 60 | 3.2 | 792 | 1055 | 75.1 | 12.0 | 6.3 | 12.7 |
| 23 | P | 0 | 43 | 57 | 2.6 | 778 | 1089 | 71.4 | 11.4 | 6.0 | 12.4 |
| 24 | A | 15 | 46 | 39 | 2.6 | 607 | 938 | 64.7 | 15.9 | 8.4 | 14.9 |
| 25 | A | 0 | 23 | 77 | 9.1 | 845 | 1011 | 83.6 | 9.1 | 5.1 | 9.2 |
| 27 | Q | 0 | 62 | 38 | 3.5 | 898 | 1101 | 81.6 | 8.3 | 4.9 | 9.1 |
| 28 | A | 0 | 43 | 57 | 3.6 | 830 | 1061 | 78.2 | 10.5 | 5.7 | 11.1 |
| 29 | D | 0 | 30 | 70 | 4.0 | 807 | 1019 | 79.2 | 11.5 | 5.9 | 11.7 |

From Tables 1 to 3, considerations can be made as follows:

In Table 3, Execution Nos. 1 to 8, 15, 20 to 23, 28, and 29 are examples manufactured according to the method of the invention, using the steels Nos. A to H, A, and M to P, respectively, which satisfy the requirements of the invention (working examples). These execution examples each have a tensile strength of 980 MPa or more, and a high yield ratio of 70% or more, and each have a TS-EL balance of 10.0 GPa·% or higher to have good properties.

On the other hand, the steel sheets that do not satisfy one or more of the requirements of the invention do not gain one or more of the desired properties.

Specifically, first, in Table 3, about Execution Nos. 9 to 14, 24 and 25, manufacturing conditions thereof do not satisfy one or more of the requirements of the invention although the steel No. A, which satisfies the requirements of the invention, is used. Thus, one or more of the desired properties are not obtained.

Of these execution examples, Execution No. 9 in Table 3 is too low in soaking temperature T1. Thus, ferrite is excessively generated so that a desired high strength and high yield ratio cannot be attained.

Execution No. 10 in Table 3 is too high in soaking temperature T1. Thus, the average crystal grain diameter of bainite becomes large so that the TS×EL balance is lowered.

Execution No. 11 in Table 3 is too small in primary cooling rate after the soaking. Thus, ferrite is excessively generated so that a desired high strength and high yield ratio cannot be attained.

Execution Nos. 12 and 13 in Table 3 are examples that are too low and too high in low-temperature-keeping temperature T2, respectively. In each of the examples, martensite is excessively generated so that the TS×EL balance is lowered.

Execution No. 14 in Table 3 is too short in low-temperature-keeping time t2. Thus, martensite is excessively generated so that the TS×EL balance is lowered.

Execution No. 24 in Table 3 is too short in soaking time t1. Thus, ferrite is excessively generated so that a desired high strength and high yield ratio cannot be attained.

Execution No. 25 in Table 3 is too long in soaking time U. Thus, the average crystal grain diameter of bainite becomes large so that the TS×EL balance is lowered.

Moreover, Execution Nos. 16 to 19, and 27 in Table 3 are manufactured, using the steels not satisfying one or more of the requirements of the invention. Thus, one or more of the desired properties are not obtained.

Of these execution examples, Execution No. 16 in Table 3 uses the steel No. I of Table 1, which is small in C content by percentage. Thus, the strength is lowered.

Execution No. 17 in Table 3 uses the steel No. J of Table 1, which is small in Mn content by percentage. Thus, ferrite is excessively generated so that high strength and high yield ratio cannot be attained.

Execution No. 27 in Table 3 uses the steel No. Q of Table 1, which is large in Mn content by percentage. Thus, hardenability is too high and hence progress of bainite transformation is slow even when it is kept in a low temperature for a sufficient time so that the proportion of martensite becomes over 50%. Therefore, TS×EL balance is lowered.

Execution No. 18 in Table 3 uses the steel No. K, which neither contains Ti, Nb nor V. The average crystal grain diameter of bainite becomes large so that the TS×EL balance is lowered.

Execution No. 19 in Table 3 uses the steel No. L, which does not contain B. Thus, ferrite is excessively generated so that a high strength and high yield ratio cannot be attained.

Example 2

In Example 1, in each of the soaking step (a) and the low-temperature-keeping step (b), the soaking or the low-temperature-keeping was conducted at a constant temperature. In present Example 2, in the steps (a) and (b), temperatures (starting temperature and finish temperature) for the soaking, and temperatures (starting temperature and finish temperature) for the low-temperature-keeping were changed as shown in Table 4.

Specifically, a hot-dip galvanized steel sheet was manufactured in the same way as in Example 1 except that the steel No. D in Table 1 satisfying the requirements of the invention was used and annealing conditions shown in Table 4 were used. Thereafter, mechanical properties thereof were measured and the structure thereof was observed in the same way as in Example 1. The results are shown in Table 5.

TABLE 4

| Execution No. | Steel No. | Heating rate (° C./sec) | Soaking conditions: Starting temperature (° C.) | Soaking conditions: Finish temperature (° C.) | Soaking conditions: Time (sec) | Primary cooling rate (° C./sec) | Low-temperature keeping conditions: Starting temperature (° C.) | Low-temperature keeping conditions: Finish temperature (° C.) | Low-temperature keeping conditions: Time (sec) | Secondary cooling rate (° C./sec) | Galvanization classification |
|---|---|---|---|---|---|---|---|---|---|---|---|
| 26 | D | 16 | 810 | 900 | 38 | 20 | 470 | 440 | 30 | 8 | GI |

TABLE 5

| Execution No. | Steel No. | Microstructure observed results: VF (%) | VM (%) | VB (%) | dB (μm) | Tensile execution results: YS (MPa) | TS (MPa) | YR (%) | EL (%) | UEL (%) | TS × EL (GPa · %) |
|---|---|---|---|---|---|---|---|---|---|---|---|
| 26 | D | 0 | 30 | 70 | 4.6 | 806 | 1021 | 78.9 | 11.2 | 5.9 | 11.4 |

As shown in Table 5, Execution No. 26 in Table 5 is high in strength and yield ratio, and further excellent in TS-EL balance. From this result, it has been verified that the desired properties can be attained even when the temperatures (starting temperature and finish temperature) for the soaking in the soaking step (a), and the temperatures (starting temperature and finish temperature) for the low-temperature-keeping in the low-temperature-keeping step (b) are changed in the scope of the invention.

From the results of present Examples, it has been verified that hot-dip galvanized steel sheets (GI steel sheets) satisfying the requirements of the invention are good in both of the properties.

What is claimed is

1. A steel sheet, which has a chemical composition comprising:

C: 0.05 mass % or more and less than 0.12 mass %,
Si: more than 0 and 0.1 mass % or less,
Mn: from 2.0 to 3.5 mass %,
at least one selected from the group consisting of Ti, Nb, and V: from 0.01 to 0.2 mass % in total,
B: from 0.0003 to 0.005 mass %,
P: 0.05 mass % or less,
S: 0.05 mass % or less,
Al: 0.1 mass % or less,
N: 0.015 mass % or less, and
Fe; and a metal structure comprising:
bainite: from 42 to 85 area %,
martensite: from 15 to 50 area %,
ferrite: 5 area % or less, and
microstructures other than the bainite, martensite and ferrite: 3 area % or less,
wherein
the bainite has an average crystal grain diameter of 7 μm or less; and
the steel sheet has a tensile strength of 980 MPa or more and a yield ratio of 71.4% or more.

2. The steel sheet of claim 1, further comprising:
Cr and Mo: 1.0 mass % or less in total.

3. A method for manufacturing the steel sheet of claim 1, the method comprising:
preparing a steel comprising:
C: 0.05 mass % or more and less than 0.12 mass %,
Si: more than 0 and 0.1 mass % or less,
Mn: from 2.0 to 3.5 mass %,
at least one selected from the group consisting of Ti, Nb, and V: from 0.01 to 0.2 mass % in total,
B: from 0.0003 to 0.005 mass %,
P: 0.05 mass % or less,
S: 0.05 mass % or less,
Al: 0.1 mass % or less,
N: 0.015 mass % or less, and
Fe;
subsequently subjecting the steel to hot rolling and cold rolling, and then keeping the steel at a temperature ranging from the $Ac_3$ point of the steel to a temperature of (the $Ac_3$+150° C.) for 5 to 200 seconds;
subsequently cooling the steel at an average cooling rate of 5° C./second or more; and
subsequently keeping the steel at a temperature ranging from the Ms point of the steel to a temperature of (the Ms point+50° C.) for 15 to 600 seconds.

4. The steel sheet of claim 1, which has a yield ratio of 73% or more.

5. The steel sheet of claim 1, wherein a proportion of the martensite in the metal structure is less than a proportion of the bainite in the metal structure.

6. The steel sheet of claim 1, wherein a product of TS×EL of the steel sheet is 10.0 GPa·% or more, where TS is the tensile strength of the steel sheet and EL is a total elongation of the steel sheet.

7. The steel sheet of claim 6, wherein the product of TS×EL of the steel sheet is 10.5 GPa·% or more.

* * * * *